US010350930B2

(12) United States Patent
Ashmore et al.

(10) Patent No.: US 10,350,930 B2
(45) Date of Patent: Jul. 16, 2019

(54) SCREEN PRINTING APPARATUS AND METHOD INCLUDING A PRINTING SCREEN HAVING A WAVE GUIDE DRIVEN TO INDUCE ULTRASONIC VIBRATIONS IN THE SCREEN

(71) Applicant: ASM ASSEMBLY SYSTEMS SINGAPORE PTE. LTD., Singapore (SG)

(72) Inventors: Clive Howard Charles Ashmore, Weymouth (GB); David Andrew Foggie, Winterbourne Steepleton (GB); Charles Henry Tones, Swanage (GB); Gerard Anthony Cox, Wareham (GB)

(73) Assignee: ASM ASSEMBLY SYSTEMS SINGAPORE PTE. LTD., Singapore (SG)

( * ) Notice: Subject to any disclaimer, the term of this patent is extended or adjusted under 35 U.S.C. 154(b) by 0 days.

(21) Appl. No.: 15/124,967

(22) PCT Filed: Apr. 10, 2015

(86) PCT No.: PCT/EP2015/057915
§ 371 (c)(1),
(2) Date: Sep. 9, 2016

(87) PCT Pub. No.: WO2015/155361
PCT Pub. Date: Oct. 15, 2015

(65) Prior Publication Data

US 2017/0057270 A1 Mar. 2, 2017

(30) Foreign Application Priority Data

Apr. 10, 2014 (GB) ..... 1406516.3

(51) Int. Cl.
*B41N 1/24* (2006.01)
*B41F 15/36* (2006.01)
(Continued)

(52) U.S. Cl.
CPC ..... *B41N 1/24* (2013.01); *B41F 15/0804* (2013.01); *B41F 15/0881* (2013.01);
(Continued)

(58) Field of Classification Search
CPC . B41N 1/24; B41F 15/08; B41F 15/36; B41F 15/34; B41F 15/0813; B41F 15/0845; B41F 35/003; B41F 35/005
See application file for complete search history.

(56) References Cited

U.S. PATENT DOCUMENTS 6,016,746 A 1/2000 Lake et al.
6,138,562 A 10/2000 Hertz et al.
(Continued)

FOREIGN PATENT DOCUMENTS

GB 1314205 A * 4/1973 ..... B06B 1/06
JP S 47-36507 12/1972
(Continued)

OTHER PUBLICATIONS

Partial English language translation of JP 2001-121673 A, which has a publication date of May 8, 2001.*
(Continued)

*Primary Examiner* — Leslie J Evanisko
(74) *Attorney, Agent, or Firm* — Ostrolenk Faber LLP

(57) ABSTRACT

A printing screen for printing deposits of a print medium onto workpieces, the printing screen comprising a sheet in which a pattern of printing apertures are formed to allow for printing of a pattern of deposits onto a workpiece, and a waveguide which can be driven to induce an ultrasonic vibration in the sheet, wherein the waveguide comprises an
(Continued)

elongate body at a surface of the sheet which at least partially surrounds the pattern of printing apertures.

21 Claims, 14 Drawing Sheets

(51) Int. Cl.
*B41F 35/00* (2006.01)
*B41F 15/08* (2006.01)
*B41M 1/12* (2006.01)

(52) U.S. Cl.
CPC ..... *B41F 15/36* (2013.01); *B41F 35/003* (2013.01); *B41F 35/005* (2013.01); *B41M 1/12* (2013.01); *B41P 2215/12* (2013.01); *B41P 2215/134* (2013.01); *B41P 2235/14* (2013.01)

(56) References Cited

U.S. PATENT DOCUMENTS

| | | | |
|---|---|---|---|
| 2003/0167941 | A1 | 9/2003 | Lin et al. |
| 2004/0123750 | A1 | 7/2004 | Rezaei |
| 2004/0124230 | A1 | 7/2004 | Hertz et al. |
| 2012/0042795 | A1 | 2/2012 | Walker |

FOREIGN PATENT DOCUMENTS

| | | | | |
|---|---|---|---|---|
| JP | S 63-120688 | | | 5/1988 |
| JP | 06255078 | A | * | 9/1994 |
| JP | 08300612 | A | * | 11/1996 |
| JP | 10202831 | A | * | 8/1998 |
| JP | 2000-117954 | A | | 4/2000 |
| JP | 2001121673 | A | * | 5/2001 |
| JP | 2001-301120 | A | | 10/2001 |
| JP | 2001-527461 | A | | 12/2001 |
| JP | 2006-347165 | A | | 12/2006 |
| KR | 10-2013-0128983 | | | 11/2013 |
| WO | WO 2011/110795 | A2 | | 9/2011 |

OTHER PUBLICATIONS

English machine translation of JP 08-300612A, publication date Nov. 19, 1996.*
English translation of Notice of Preliminary Rejection dated Aug. 20, 2017 for Korean Application No. 10-2016-7031054.
English translation of Notice of Reasons for Rejection dated Dec. 18, 2017 for Japanese Application No. 2017-504269.

* cited by examiner

SCREEN PRINTING APPARATUS AND METHOD INCLUDING A PRINTING SCREEN HAVING A WAVE GUIDE DRIVEN TO INDUCE ULTRASONIC VIBRATIONS IN THE SCREEN

CROSS REFERENCE TO RELATED APPLICATIONS

The present application is a 35 U.S.C. § 371 National Phase conversion of PCT/EP2015/057915, filed Apr. 10, 2015, which claims benefit of United Kingdom patent application no. 1406516.3, filed Apr. 10, 2014, the disclosures of which are incorporated herein by reference. The PCT International Application was published in the English language.

TECHNICAL FIELD OF THE INVENTION

The present invention relates to a screen printing apparatus for and a method of printing on workpieces, in particular electronic substrates, such as circuit boards or packages and wafers, for example, for solar or fuel cell applications.

BACKGROUND OF THE INVENTION

Various screen printing apparatus exist which utilize vibration of the screen printing head, including the present applicant's ProActiv™ print head, and systems have also been conceived for vibration of the printing screen.

SUMMARY OF THE INVENTION

It is an aim of the present invention to provide an improved screen printing apparatus and method, and in particular which allows for printing with apertures which have a reduced print area ratio.

In one aspect the present invention provides a printing screen for printing deposits of a print medium onto workpieces, the printing screen comprising a sheet in which a pattern of printing apertures are formed to allow for printing of a pattern of deposits onto a workpiece, and a waveguide which can be driven to induce an ultrasonic vibration in the sheet, wherein the waveguide comprises an elongate body at a surface of the sheet which at least partially surrounds the pattern of printing apertures.

In one embodiment the elongate body of the waveguide extends to at least two sides of the pattern of printing apertures.

In one embodiment the elongate body of the waveguide extends to at least two opposite sides of the pattern of printing apertures.

In one embodiment the elongate body of the waveguide substantially surrounds the pattern of printing apertures, optionally at a periphery of the sheet.

In one embodiment the sheet comprises a solid, continuous sheet, optionally a metal sheet.

In one embodiment the elongate body of the waveguide comprises a plurality of elements which are disposed to adjacent sides of the pattern of printing apertures, and are coupled at corners, optionally radiused corners.

In one embodiment the elongate body of the waveguide has a length which corresponds to a multiple of a quarter wavelength of a guided ultrasonic wave.

In one embodiment the waveguide is formed separately of the sheet.

In one embodiment the waveguide is attached to the sheet.

In one embodiment the waveguide is bonded to the sheet.

In one embodiment the waveguide is bonded to the sheet using a bonding agent.

In one embodiment the bonding agent comprises an adhesive, optionally an acrylic adhesive, more optionally a methacrylate structural adhesive.

In another embodiment the waveguide is welded to the sheet.

In another embodiment the waveguide is rested on the sheet, without being directly attached.

In another embodiment the waveguide is integrally formed with the sheet, optionally projecting from one surface of the sheet or from both opposite surfaces of the sheet.

In one embodiment the printing screen is formed by machining, cutting and/or etching operations.

In another embodiment the printing screen is electroformed, whereby the waveguide is grown out of one or both surfaces of the sheet.

In another aspect the present invention provides a printing screen unit, comprising: the above-described printing screen; a frame which supports the printing screen; and an ultrasonic generator which is operative to deliver an ultrasonic wave to the waveguide of the printing screen.

In one embodiment the printing screen is maintained under tension within the frame.

In one embodiment the ultrasonic generator comprises an ultrasonic actuator, optionally a piezoelectric element, which is coupled to the waveguide.

In one embodiment the ultrasonic actuator is coupled to an anti-nodal point along a length of the waveguide, optionally at one distal end of the waveguide.

In one embodiment the ultrasonic actuator is driven to induce a vibration in the waveguide in the range of from about 20 kHz to about 80 kHz, optionally from about 30 kHz to about 60 kHz, more optionally from about 35 kHz to about 55 kHz.

In one embodiment the ultrasonic actuator is driven at a power of less than 10 W, optionally at a power of between about 2.5 W and 7.5 W.

In a further aspect the present invention provides a method of printing deposits of a print medium onto workpieces, the method comprising the steps of: providing the above-described printing screen unit; providing a workpiece support which supports a workpiece in relation to the printing screen unit; providing a print head unit comprising a print head which is operable in a printing operation to drive a print medium through the pattern of printing apertures in the printing screen of the printing screen unit; moving the printing screen unit and the workpiece support in relation to one another such that a workpiece is disposed adjacent the pattern of apertures in the printing screen of the printing screen unit; operating the print head unit to perform a printing operation in which print medium is driven through the pattern of printing apertures in the printing screen of the printing screen unit onto the workpiece; separating the printing screen of the printing screen unit and the workpiece support following the printing operation; and operating the ultrasonic generator to deliver an ultrasonic wave to the waveguide of the printing screen of the printing screen unit at least during part of the separating step.

In one embodiment the ultrasonic generator is operated during the separating step.

In one embodiment actuation of the ultrasonic generator is initiated prior to performing the separating step or simultaneously with initiating the separating step.

In one embodiment the ultrasonic generator is operated during at least part of the printing operation.

In one embodiment the ultrasonic generator is operated during the printing operation.

In one embodiment actuation of the ultrasonic generator is initiated prior to the printing operation or simultaneously with initiating the printing operation.

In one embodiment the print head unit further comprises a waveguide which is operable to induce an ultrasonic vibration in the print head and a further ultrasonic generator which is operable to deliver an ultrasonic wave to the waveguide of the print head unit, and further comprising the step of: operating the further ultrasonic generator to deliver an ultrasonic wave to the waveguide of the print head unit at least during part of the printing operation.

In one embodiment the further ultrasonic generator is actuated during the printing operation.

In one embodiment actuation of the further ultrasonic generator is initiated prior to the printing operation or simultaneously with initiating the printing operation.

In one embodiment the further ultrasonic generator is operated at least during part of the separating step.

In one embodiment the further ultrasonic generator is operated during the separating step.

In one embodiment the print head, optionally comprising a squeegee, is traversed over a surface of the printing screen in the printing operation.

In one embodiment the print medium is a solder paste, a silver paste or an adhesive.

BRIEF DESCRIPTION OF THE DRAWINGS

Preferred embodiments of the present invention will now be described hereinbelow by way of example only with reference to the accompanying drawings, in which:

FIG. 6(*b*) illustrates a print result where the print head but not the printing screen is actuated in accordance with the described Example;

FIG. 6(*c*) illustrates a print result where the printing screen but not the print head is actuated in accordance with the described Example;

FIG. 6(*d*) illustrates a print result where the printing screen and the print head are actuated in accordance with the described Example;

FIG. 7(*b*) illustrates a side view of the printing screen unit of FIG. 7(*a*);

FIG. 7(*c*) illustrates a plan view of the printing screen unit of FIG. 7(*a*);

FIG. 7(*d*) illustrates an enlarged plan view of detail A in FIG. 7(*c*);

FIG. 8(*b*) illustrates a plan view of the waveguide of FIG. 8(*a*);

FIG. 8(*c*) illustrates a side view of the waveguide of FIG. 8(*a*);

DESCRIPTION OF PREFERRED EMBODIMENTS

Figure 1:
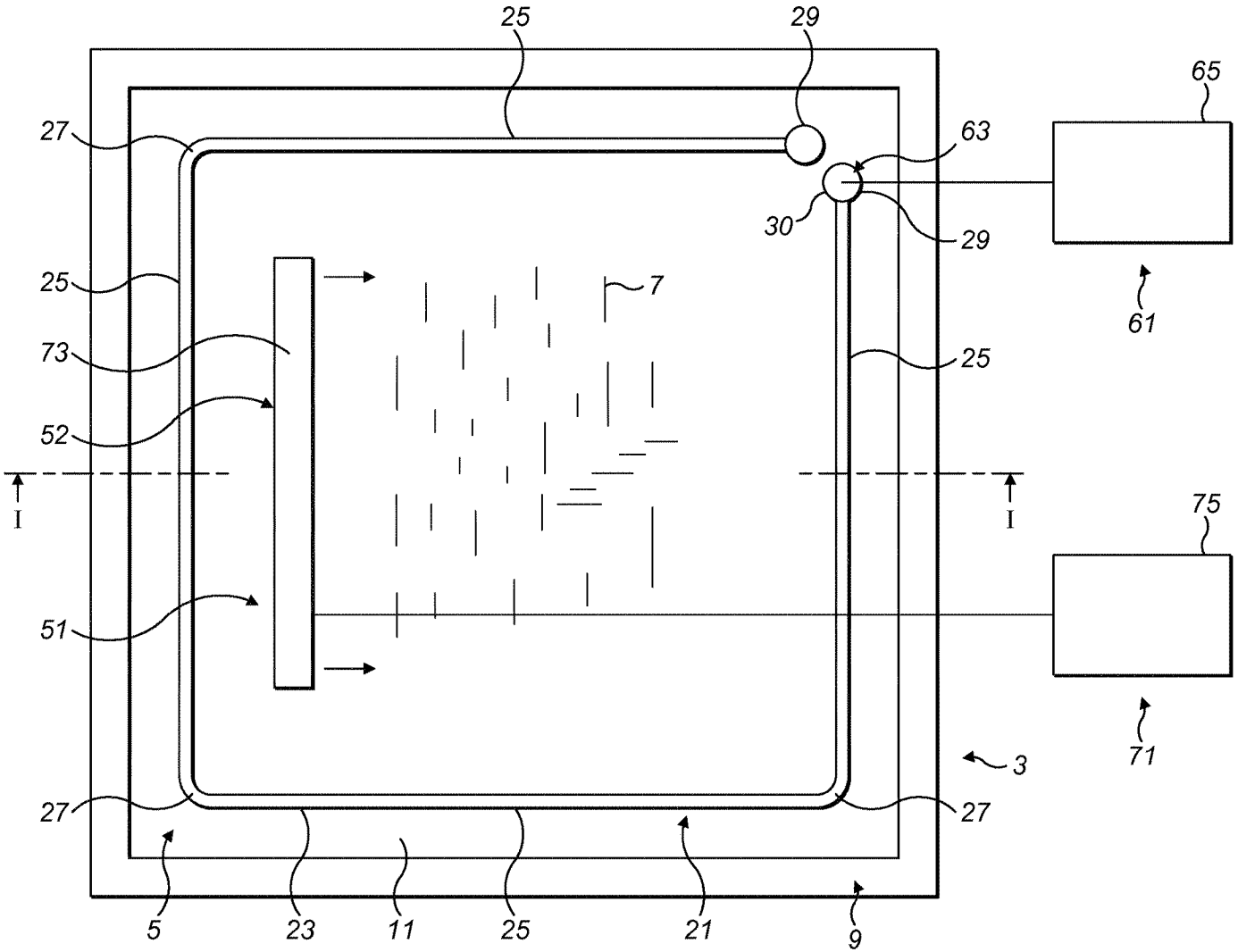
FIG. 1 illustrates a screen printing apparatus in accordance with a first embodiment of the present invention.
Figure 2:
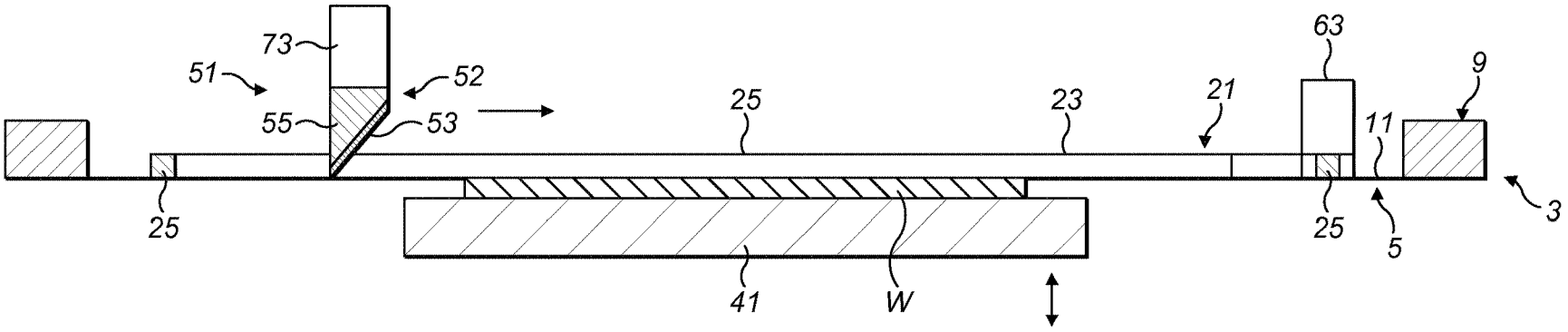
FIG. 2 illustrates a vertical sectional view (along section I-I in FIG. 1) of the screen printing apparatus of FIG. 1.

FIGS. 1 and 2 illustrate a screen printing apparatus in accordance with one embodiment of the present invention.

The screen printing apparatus comprises a printing screen unit 3, which comprises a printing screen 5 which includes a pattern of printing apertures 7 therein which define a pattern of deposits to be printed on a workpiece W therebelow, and a frame 9 which supports the printing screen 5, in this embodiment under tension.

The printing screen 5 comprises a sheet 11, here a solid, continuous sheet, in the form of a stencil.

In this embodiment the sheet 11 is formed from a metal sheet, but could alternatively be formed from a plastics sheet.

In an alternative embodiment the sheet 11 could be formed from a mesh, in the form of a mesh screen. In one embodiment the sheet 11 could be a metal mesh, but alternatively could be formed with a plastics mesh.

The printing screen 5 further comprises a waveguide 21 which can be driven to induce an ultrasonic vibration in the sheet 11, as will be described in more detail hereinbelow.

In this embodiment the waveguide 21 comprises an elongate body 23 at a surface of the sheet 11 which extends to at least two opposite sides of the pattern of printing apertures 7, in this embodiment substantially surrounding the pattern of printing apertures 7.

In this embodiment the elongate body 23 comprises a plurality of elements 25, which are disposed to adjacent sides of the pattern of printing apertures 7, here each being coupled by radiused corners 27 and terminating at distal ends 29, with one distal end providing an actuator node 30 to which an ultrasonic actuator 63 is coupled, as will be described in more detail hereinbelow.

In this embodiment the elongate body 23 has a length which corresponds to a quarter of the wavelength of the guided wave.

In this embodiment the elongate body 23 has a rectangular section, with a width of 4 mm and a height of 4 mm. In an alternative embodiment the elongate body could have a height of 2 mm.

In preferred embodiments the elongate body 23 has a width of less than about 5 mm, and optionally more than about 2 mm.

In preferred embodiments the elongate body 23 has a height of less than about 5 mm, optionally less than about 3 mm, and optionally more than about 1 mm.

In this embodiment the radiused corners 27 have an inner radius of 35 mm.

In this embodiment the waveguide 21 is formed of aluminum. In an alternative embodiment the waveguide 21 could be formed of stainless steel.

In this embodiment the waveguide 21 is formed separately of the sheet 11.

In this embodiment the waveguide 21 is attached to the sheet 11, here bonded using an adhesive, here an acrylic adhesive, such as a methacrylate structural adhesive. In this embodiment the adhesive is a Crestabond M1 adhesive, optionally a Crestabond M1-05 adhesive (as supplied by Scott Bader, Wollaston, UK).

In an alternative embodiment the waveguide 21 could be welded to the sheet 11.

In another embodiment the waveguide 21 could be rested on the sheet 11, without being directly attached.

In another alternative embodiment the waveguide 21 could be integrally formed with the sheet 11. In one embodiment the waveguide 21 could project from one surface of the sheet 11. In another embodiment the waveguide 21 could project from both upper and lower surfaces of the sheet 11.

In one embodiment the printing screen 5 could be formed by machining, cutting and/or etching operations.

In another embodiment the printing screen 5 could be electroformed, whereby the waveguide 21 is grown out of a surface of the sheet 11.

The screen printing apparatus further comprises a workpiece support 41 which supports a workpiece W in relation to the printing screen unit 3, in this embodiment at a printing zone beneath the printing screen 5 of the printing screen unit 3.

The screen printing apparatus further comprises a print head unit 51 which is operative in a printing operation to drive a print medium, typically a solder paste, a silver paste or an adhesive, through the pattern of printing apertures 7 in the printing screen 5.

In this embodiment the print head unit 51 comprises a print head 52, here comprising a squeegee 53, which is traversed over the surface of the printing screen 5 in the printing operation.

In this embodiment the print head 52 includes a waveguide 55 which can be driven to induce an ultrasonic vibration in the squeegee 53.

The screen printing apparatus further comprises a first ultrasonic generation unit 61 which is operative to deliver an ultrasonic wave to the waveguide 21 of the printing screen unit 3.

In this embodiment the first ultrasonic generation unit 61 comprises an ultrasonic actuator 63, here a piezoelectric element, which is coupled to the waveguide 21, and a power supply 65 which drives the actuator 63.

In this embodiment the actuator 63 is coupled to the actuator node 30 at the one of the distal ends 29 of the waveguide 21, but could alternatively be coupled at any anti-nodal point along the length thereof.

In this embodiment the actuator 63 is driven to induce a vibration in the waveguide 21 in the range of from about 20 kHz to about 80 kHz, optionally from about 30 kHz to about 60 kHz, more optionally from about 35 kHz to about 55 kHz.

In this embodiment the actuator 63 is driven at a power of less than 10 W, and preferably at a power of between about 2.5 W and 7.5 W.

The screen printing apparatus further comprises a second ultrasonic generation unit 71 which is operative to deliver an ultrasonic wave to the waveguide 55 of the print head 52.

In this embodiment the second ultrasonic generation unit 71 comprises an ultrasonic actuator 73, here a piezoelectric element, which is coupled to the waveguide 55, and a power supply 75 which drives the actuator 73.

In this embodiment the actuator 73 is driven to induce a vibration in the waveguide 55 in the range of from about 20 kHz to about 80 kHz, optionally from about 30 kHz to about 60 kHz, optionally from about 35 kHz to about 55 kHz.

With ultrasonic actuation of the printing screen 5 using the waveguide 21 of the present invention, it has been found that print area ratios, that is, the ratio of the area of the sidewalls of a print aperture to open aperture area, can be achieved which are less than 0.4. This compares to existing print methodologies which can only achieve print area ratios of at best 0.5, and then only using specialized solder pastes. The present invention thus represents a transformational improvement in deposition, which allows for the printing of smaller deposits using thinner printing screens.

The present invention will now be described hereinbelow by way of example only with reference to the following non-limiting Example.

The print head 52 was a ProActiv™ print head operated at a frequency of 29 to 35 kHz, a print speed of 50 mm per second and a print pressure of 4 Kg.

The squeegee 53 was a metal squeegee having a length of 170 mm and an angle of 60 degrees.

The printing screen 5 was a 100 μm stainless screen (VectorGuard®) having a pattern of apertures 7 of a size 150 μm round and configured for a 0.3 mm chip-scale package (CSP).

The separation speed in separating the workpiece W from the printing screen 5 following printing was 3 mm per second.

The print medium was a solder paste (as supplied by Koki Company Limited, Japan).

In this Example, the waveguide 21 of the printing screen 5 was actuated to induce a vibration in the stencil sheet 11 at frequencies of 31.56, 45.78 and 60 kHz at power levels of 2.5, 5 and 7.5 W.

Figure 3:
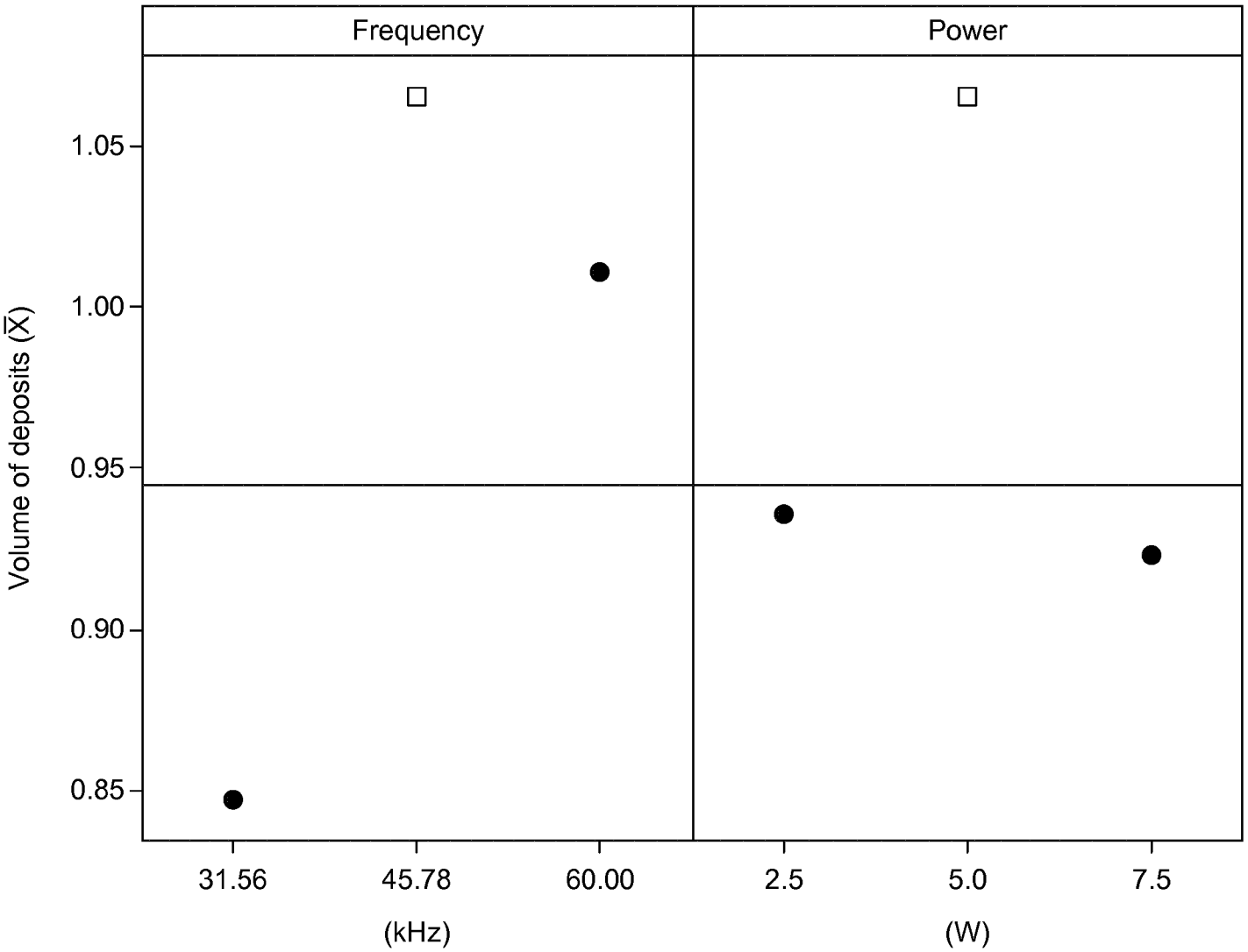
FIG. 3 illustrates plots of the sample mean (X-bar) for the volume of printed deposits as a function of frequency and power in accordance with the described Example.

FIG. 3 illustrates plots of the sample mean (X-bar) for the volume of print deposits as a function of frequency and power.

As will be seen, an optimum frequency is observed at around 45 kHz, and an optimum power is observed at around 5 W. It had been expected that transfer efficiency would scale with power, and the existence of an optimal power peak at a relatively low power is surprising.

Figure 4:
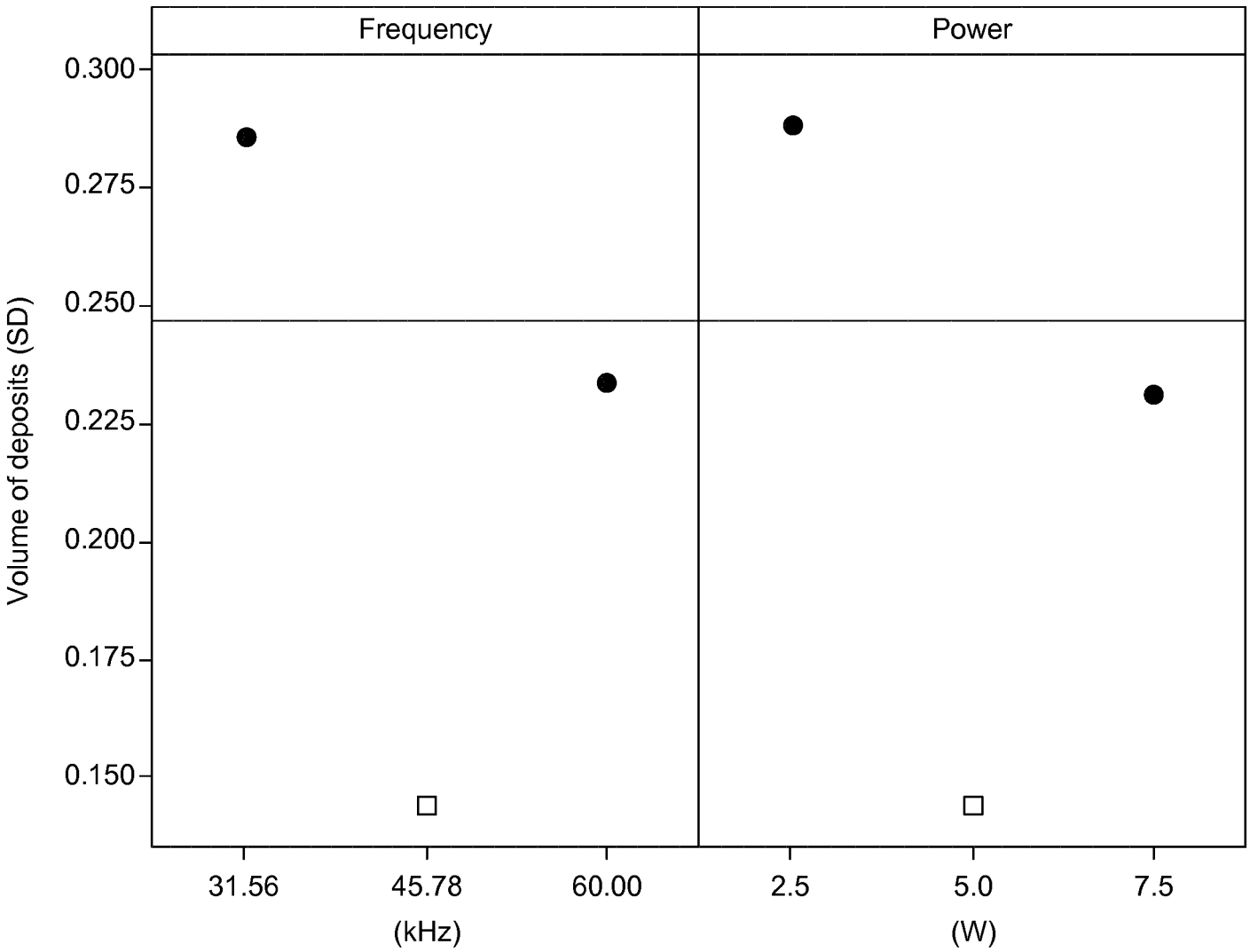
FIG. 4 illustrates plots of standard deviation for the volume of print deposits as a function of frequency and power in accordance with the described Example.

FIG. 4 illustrates plots of standard deviation for the volume of print deposits as a function of frequency and power.

As will be observed, the optimal values for frequency and power also exhibit markedly lower standard deviation in the volume of printed deposits, thus providing, not only for increased transfer efficiency, but also significantly increased uniformity to the deposits.

Figure 5:
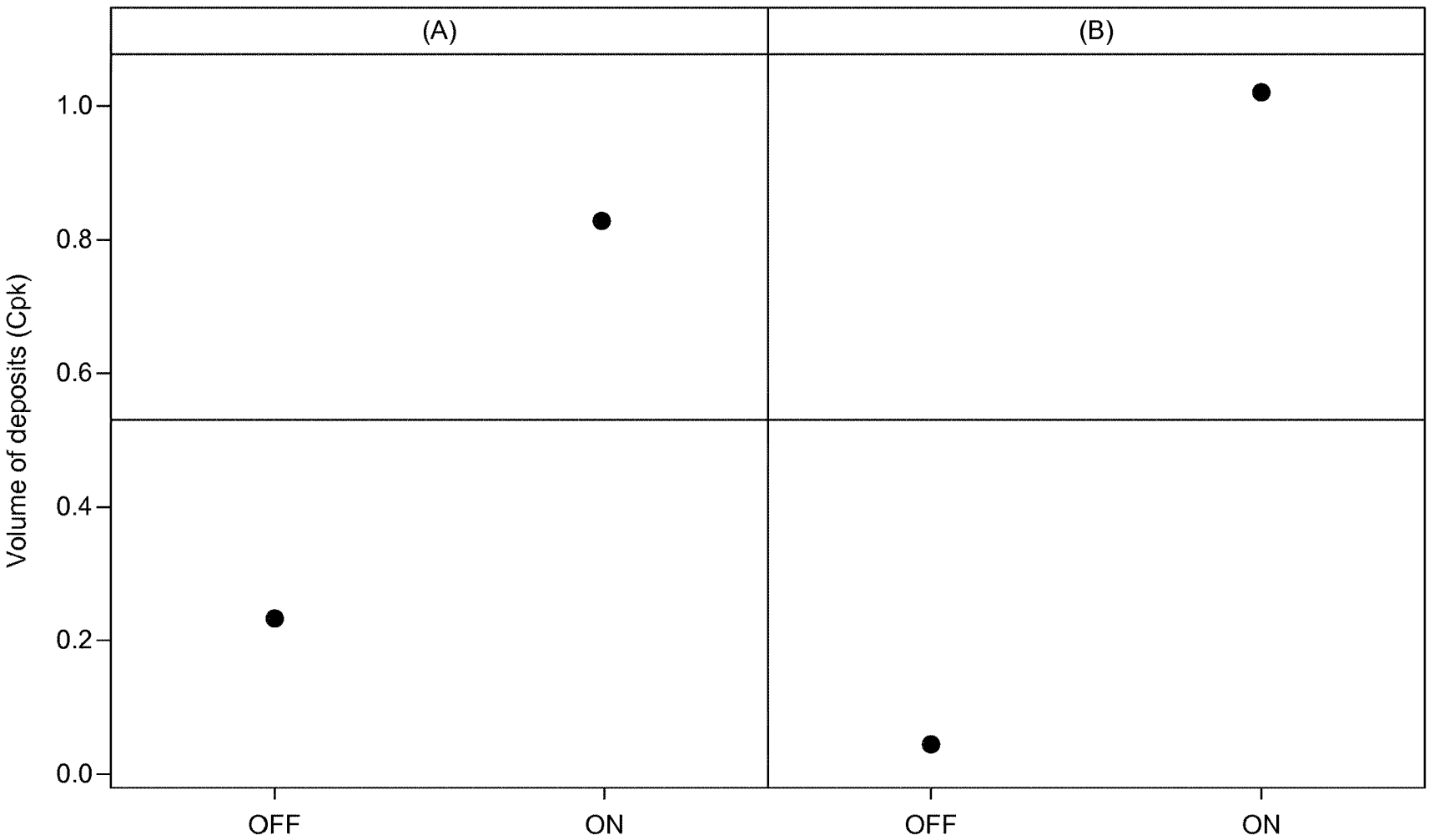
FIG. 5 illustrates, by way of the process capability index ($C_{pk}$), the contribution in terms of a relative increase in transfer efficiency arising from ultrasonic actuation of the print head (A) as compared to the printing screen (B) in accordance with the described Example.
Figure 6A:
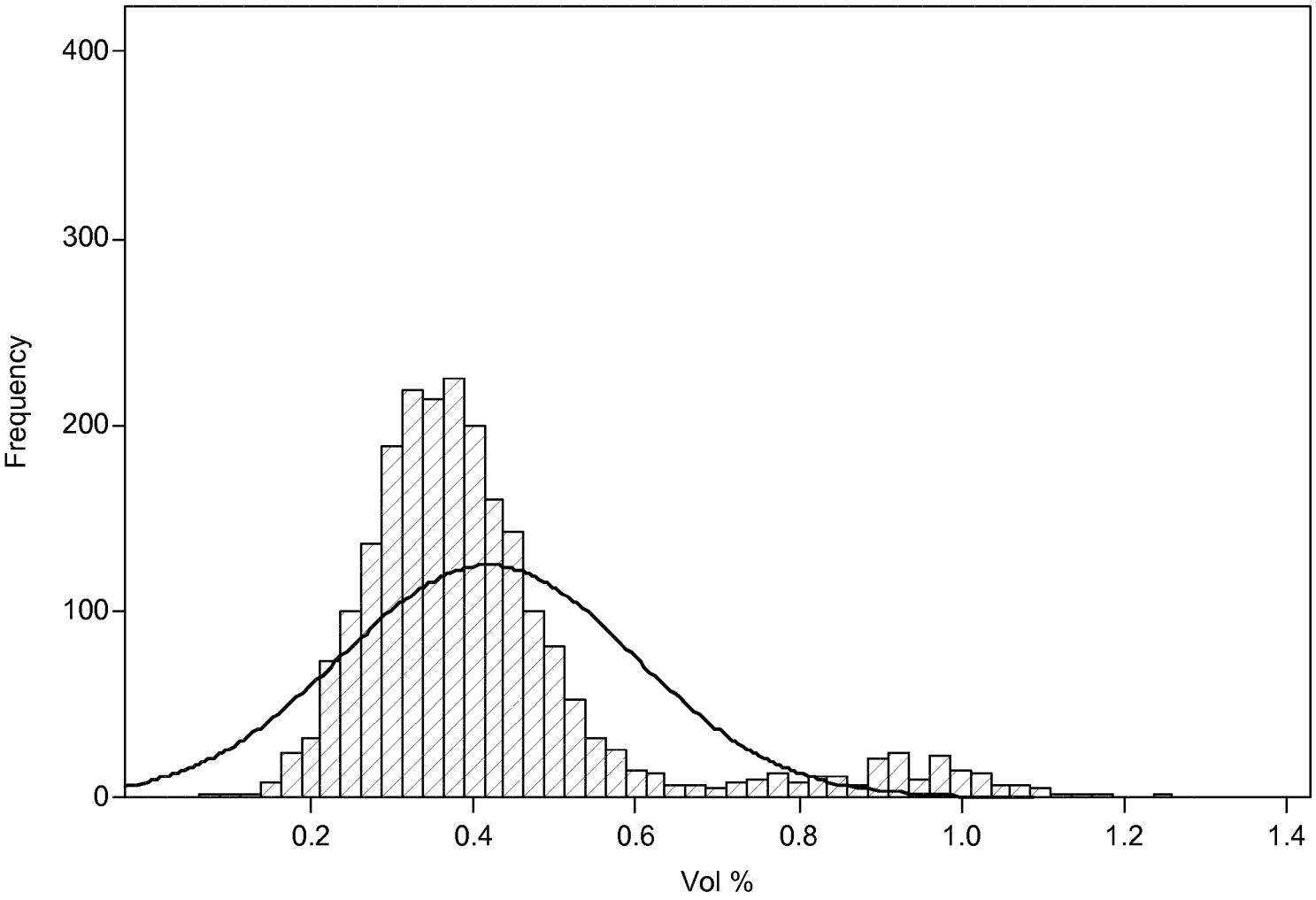
FIG. 6(*a*) illustrates a print result where neither the printing screen nor the print head is actuated in accordance with the described Example.
Figure 6B:
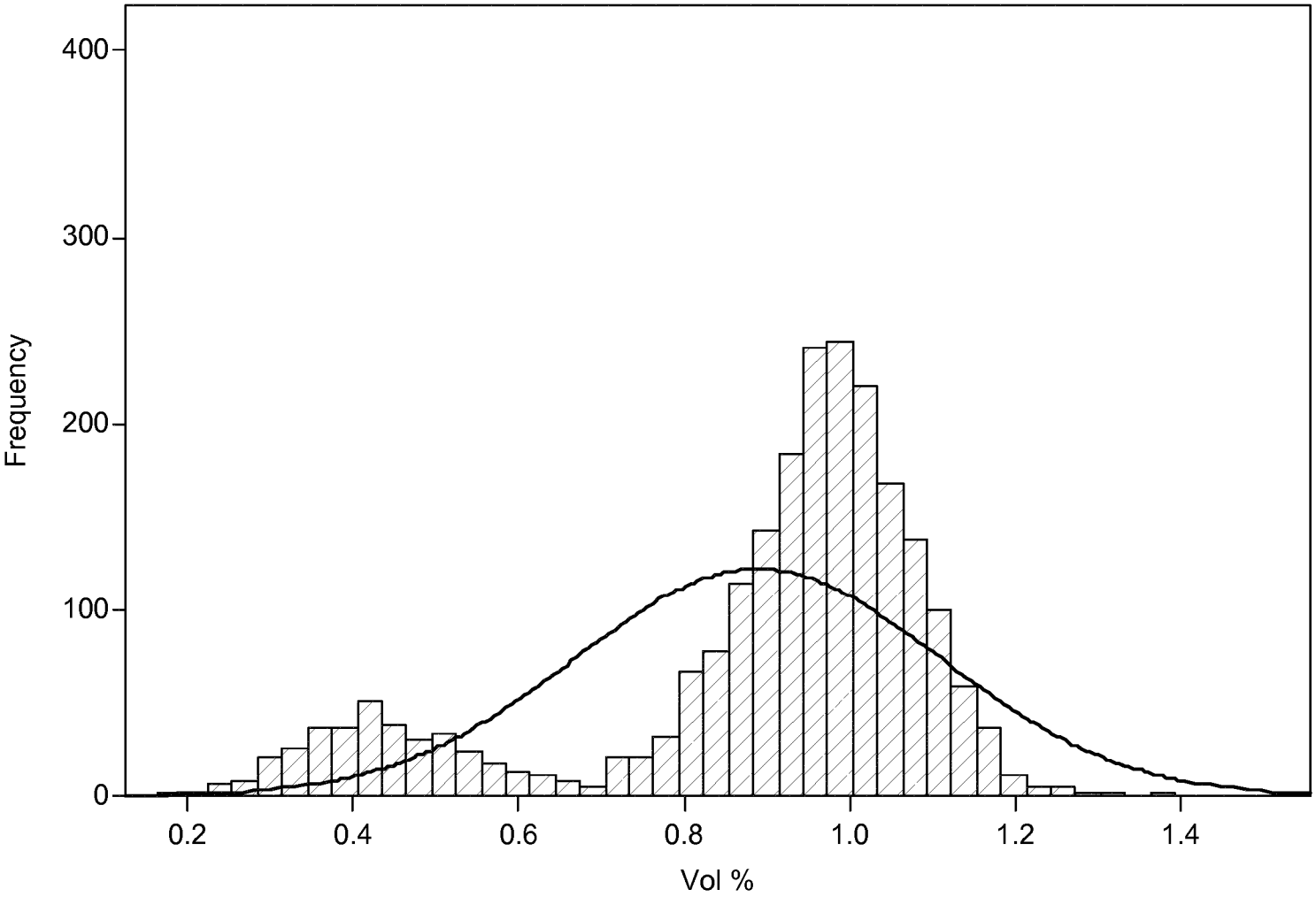
Figure 6C:
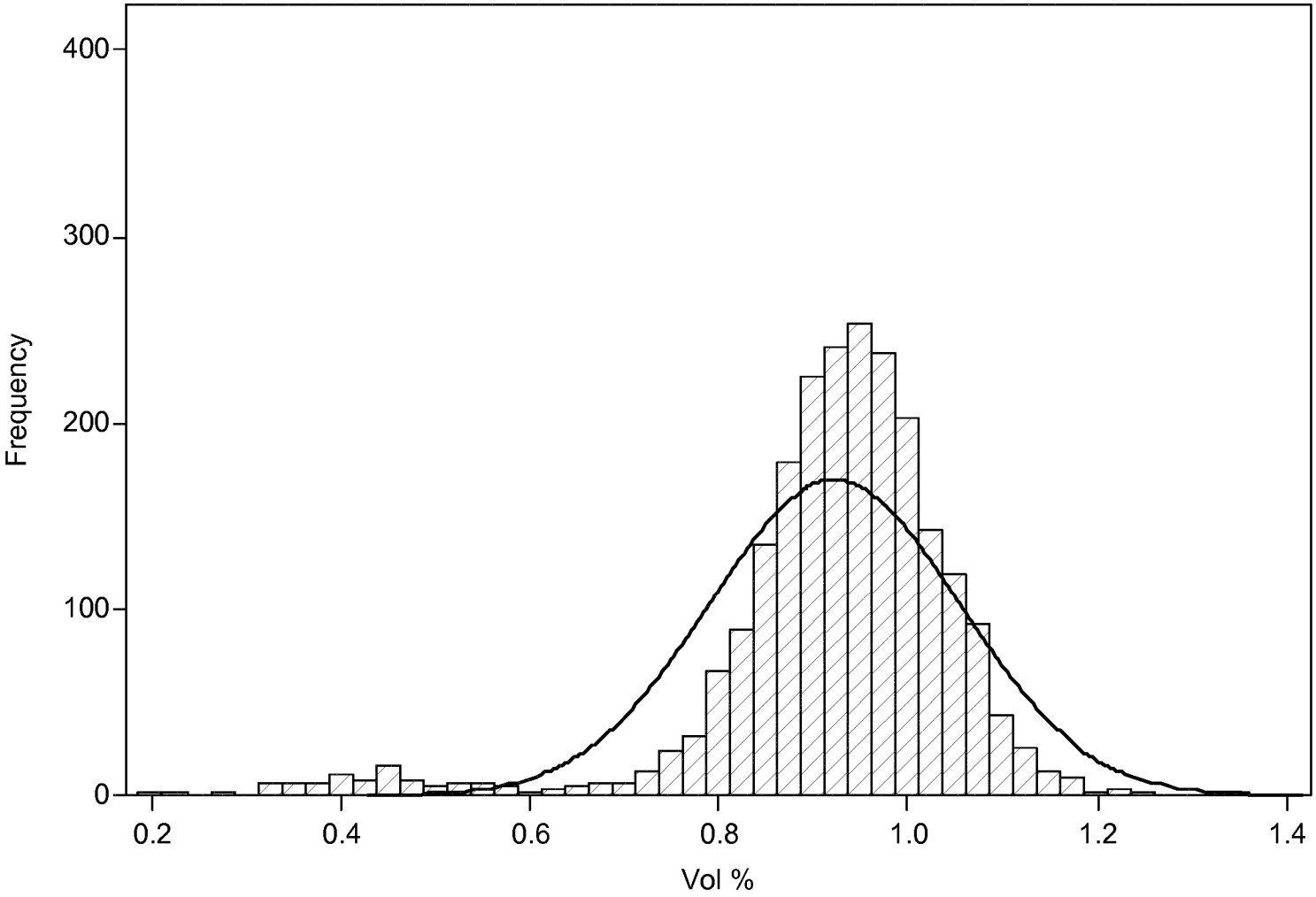
Figure 6D:
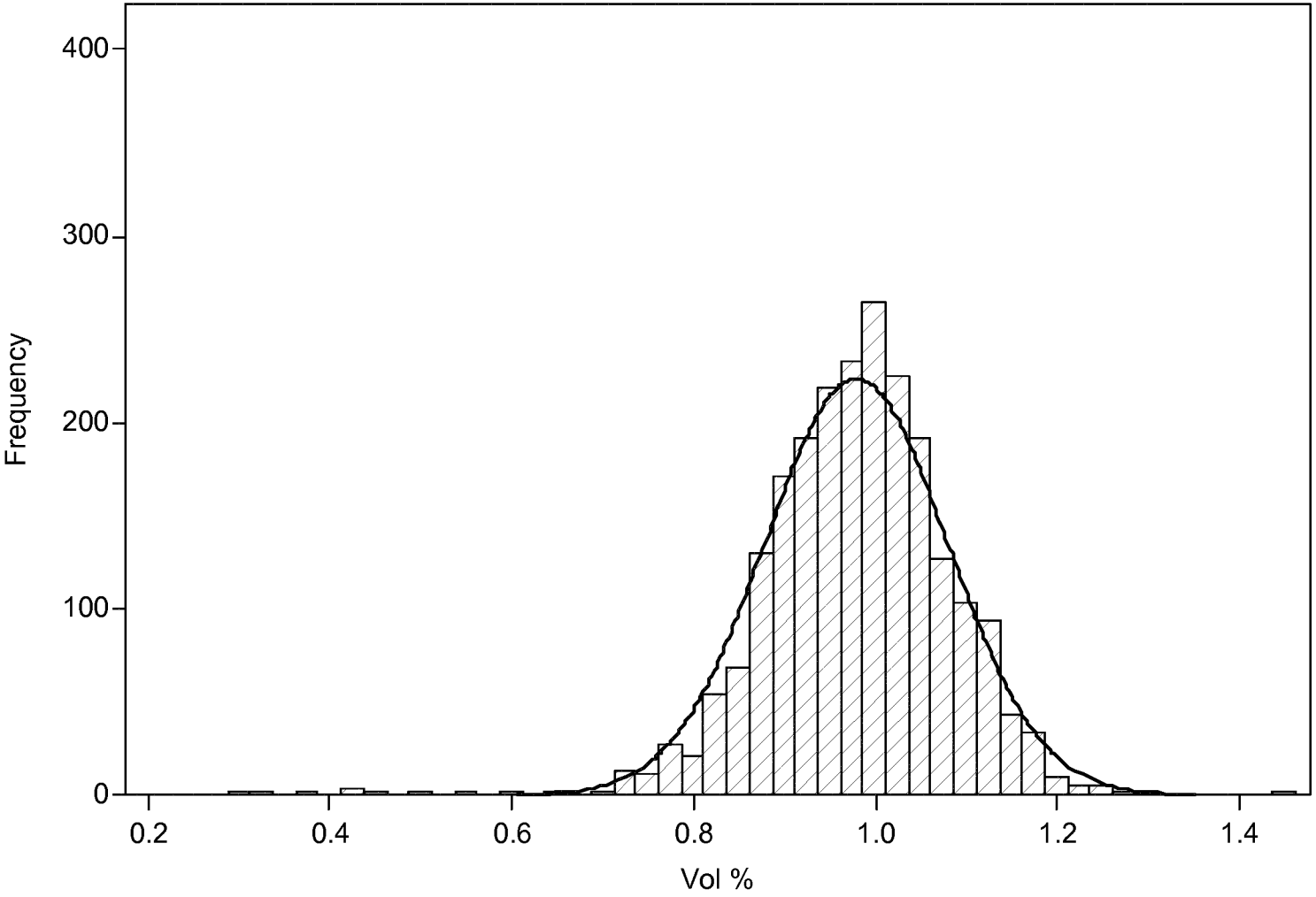
Figure 7A:
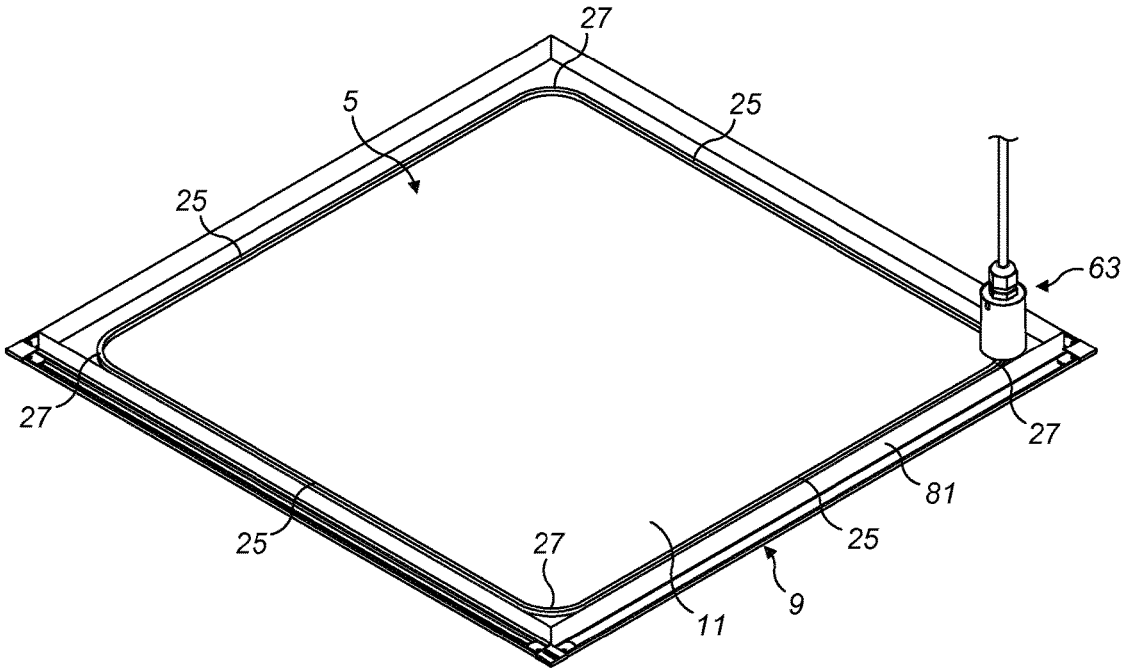
FIG. 7(*a*) illustrates a perspective view of a printing screen unit in accordance with a second embodiment of the present invention.
Figure 7B:
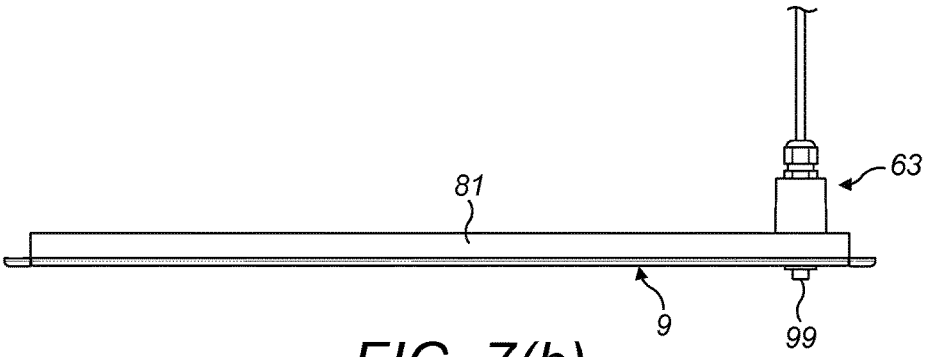
Figure 7C:
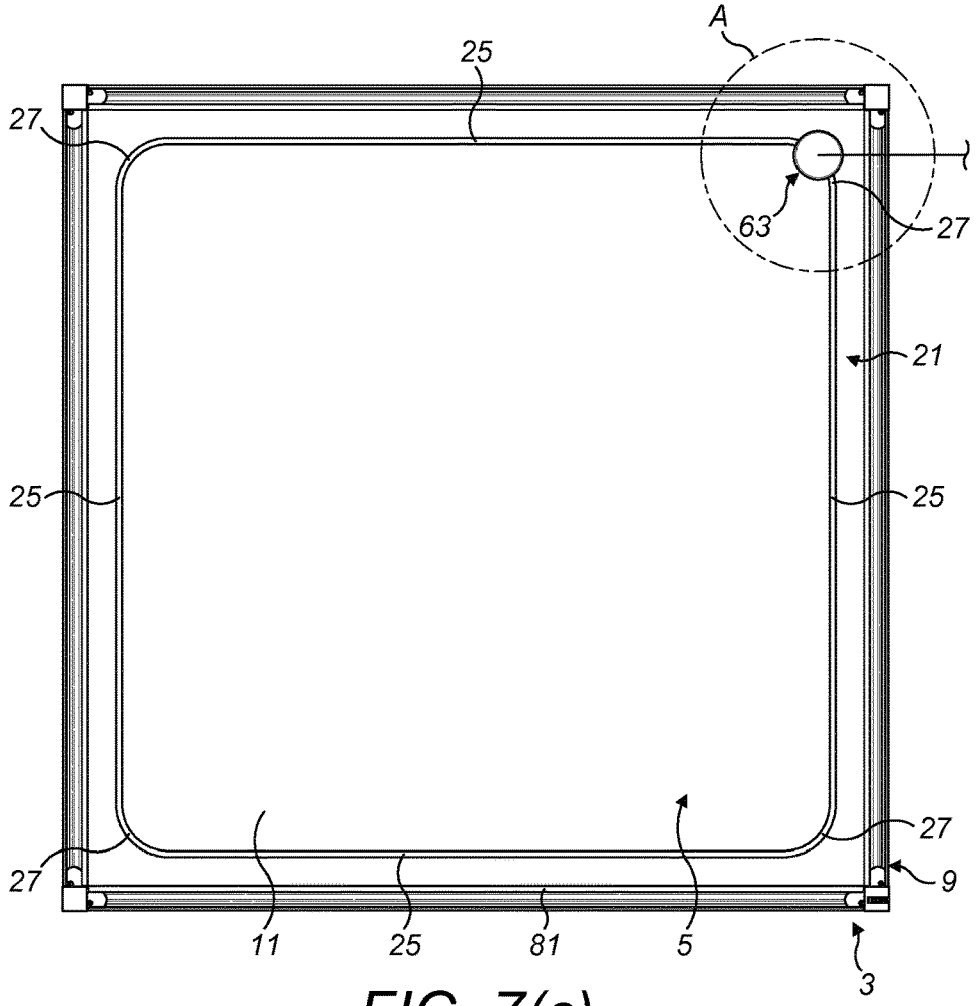
Figure 7D:
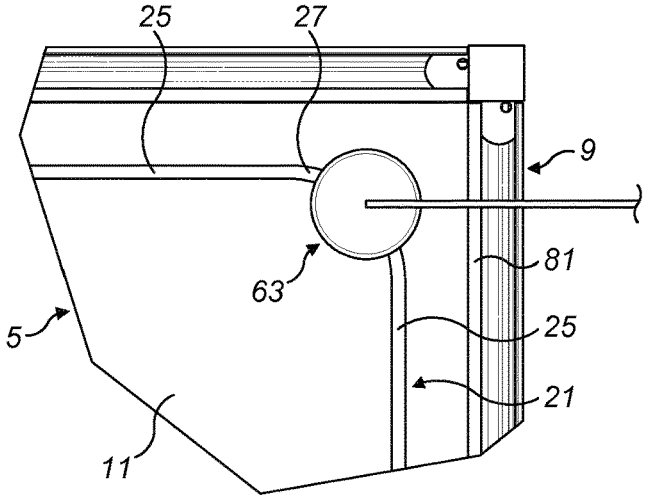

FIG. 5 illustrates, by way of the process capability index ($C_{pk}$), the contribution in terms of a relative increase in transfer efficiency arising from ultrasonic actuation of the print head 52 (A) as compared to the printing screen 5 (B).

The effect of ultrasonic actuation of the printing screen 5 alone and in combination with ultrasonic actuation of the print head 52 can be clearly observed in FIGS. 6(*a*) to (*d*), which represent print results from 2250 apertures.

FIG. 6(*a*) illustrates a print result where neither the printing screen 5 nor the print head 52 are ultrasonically actuated, with the mean being 0.4182 and the SD being 0.1802.

FIG. 6(*b*) illustrates a print result where the print head 52 but not the printing screen 5 is ultrasonically actuated, with the mean being 0.804 and the SD being 0.2212.

FIG. 6(*c*) illustrates a print result where the printing screen 5 but not the print head 52 is ultrasonically actuated, with the mean being 0.9232 and the SD being 0.1326.

FIG. 6(*d*) illustrates a print result where the printing screen 5 and the print head 52 are both ultrasonically actuated, with the mean being 0.9802 and the SD being 0.1006.

As will be observed, a significant improvement is achieved by ultrasonic actuation of the printing screen 5, especially in the print uniformity, and this improvement is further enhanced when the printing screen 5 and the print head 52 are both ultrasonically actuated.

Figure 8A:
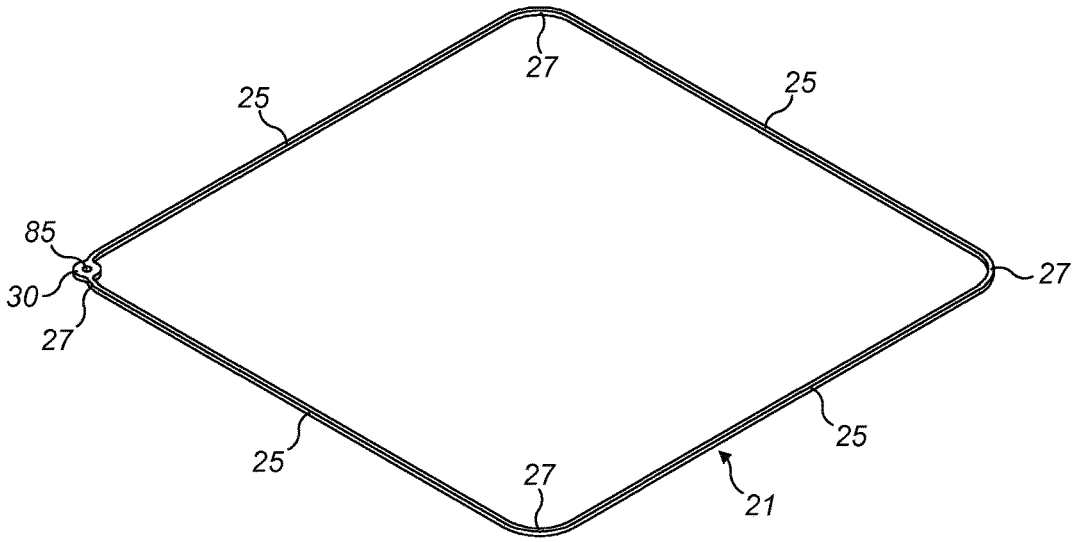
FIG. 8(*a*) illustrates a perspective view of the waveguide of the printing screen unit of FIG. 7(*a*)
Figure 8B:
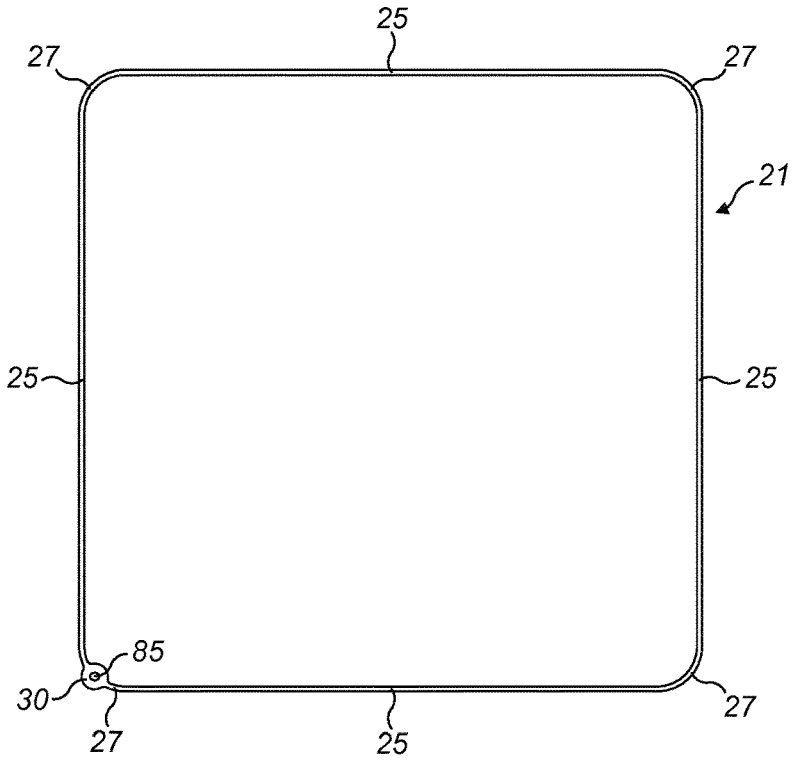
Figure 8C:
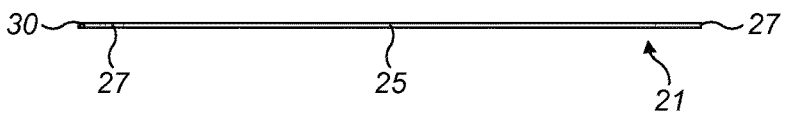
Figure 9:
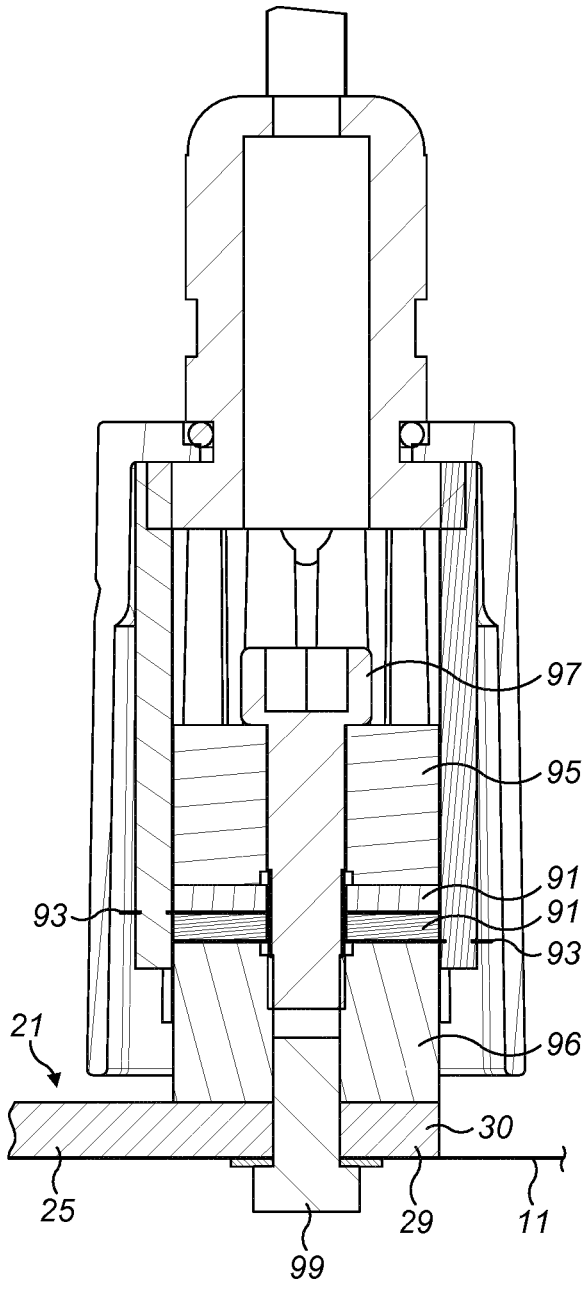
FIG. 9 illustrates a vertical sectional view of the actuator of printing screen unit of FIG. 7(*a*)

FIGS. 7 to 9 illustrate a screen printing apparatus in accordance with a second embodiment of the present invention.

The screen printing apparatus of this embodiment is quite similar to that of the first-described embodiment, and thus, in order to avoid unnecessary duplication of description, only the differences will be described in detail, with like parts being designated by like reference signs.

The screen printing apparatus of this embodiment differs from that of the first-described embodiment in that the frame 9 is not a rigid frame which maintains tension on the sheet 11 of the printing screen 5 in any condition, but a frame which supports the printing screen 5 in an untensioned state when de-mounted and allows for tensioning of the printing screen 5 by external tensioning mechanisms. In this embodiment the frame 9 is a VectorGuard® frame, as supplied by DEK (Weymouth, UK).

In this embodiment the printing screen 5 further differs in having an upstand 81 which extends about the periphery of the sheet 11 and projects from the surface of the sheet 11 to a greater extent than the waveguide 21, thereby protecting the waveguide 21 when the printing screen unit 3 is rested on a surface.

In this embodiment the printing screen 5 further differs in that the elongate body 23 of the waveguide 21 is a single, continuous element which includes one actuator node 30 in the path of the elongate body 23. In this embodiment the actuator node 30 includes a through aperture 85 in correspondence with an aperture in the sheet 11 of the printing screen 5, which allows for the fixing of the ultrasonic actuator 63 thereto, as will be described in more detail below.

In this embodiment, as illustrated in FIG. 9, the ultrasonic actuator 63 comprises first and second piezoelectric elements 91, here annular discs, in opposed relation, and electrical connectors 93 which are electrically connected to the power supply 65. In this embodiment the positive poles of the piezoelectric elements 91 face one another.

In this embodiment the ultrasonic actuator 63 further comprises first and second mass elements 95, 96 here front and rear mass elements, which are disposed to opposite sides of the piezoelectric elements 91, and a fixing 97 which interconnects the mass elements 95, 96 and compresses the piezoelectric elements 91 to a predetermined compression, such that the ultrasonic actuator 63 resonates at a predetermined frequency.

In this embodiment the ultrasonic actuator 63 is fixed to the actuator node 30 of the waveguide 21, here by a fixing 99, here threaded, which passes through the aperture 85 in the actuator node 30, whereby the front mass element 96 is engaged to and coupled with the actuator node 30.

Figure 10:
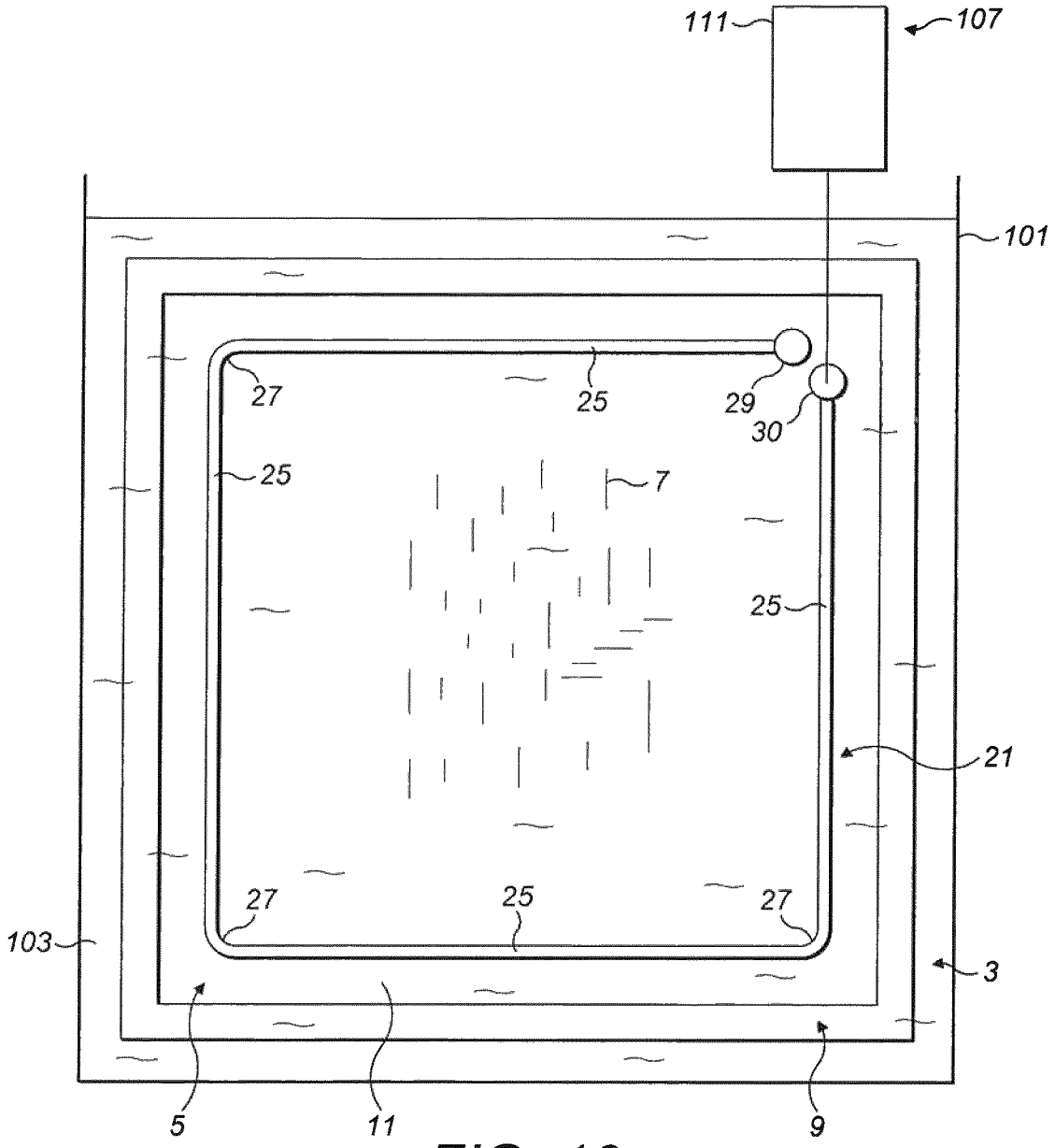
FIG. 10 illustrates a screen cleaning apparatus in accordance with one embodiment of the present invention.

FIG. 10 illustrates a screen cleaning apparatus in accordance with one embodiment of the present invention.

The screen cleaning apparatus comprises a cleaning bath 101, here in the form of a tank, which contains a cleaning fluid 103 and receives at least one printing screen unit 3.

In this embodiment the printing screen 5 is disposed in the cleaning bath 101 when mounted to the frame 9, but in an alternative embodiment could be de-mounted from the frame 9.

The screen cleaning apparatus further comprises an ultrasonic generation unit 107 which is operative to deliver an ultrasonic wave to the waveguide 21 on the printing screen 5 and provide for cleaning of the printing screen 5.

In this embodiment the ultrasonic generation unit 107 comprises an ultrasonic actuator 109, here a piezoelectric element, which is coupled to the waveguide 21, and a power supply 111 which drives the actuator 109.

In this embodiment the actuator 109 is coupled to one of the distal ends 29 of the waveguide 21, but could alternatively be coupled at any anti-nodal point along the length thereof.

In this embodiment the actuator 109 is driven to induce a vibration in the waveguide 21 in the range of from about 20 kHz to about 80 kHz, optionally from about 30 kHz to about 60 kHz, more optionally from about 35 kHz to about 55 kHz.

In this embodiment the actuator 109 is driven at a power of less than 10 W, and preferably at a power of between about 2.5 W and 7.5 W.

Finally, it will be understood that the present invention has been described in its preferred embodiments and can be modified in many different ways without departing from scope of the invention as defined by the appended claims.

What is claimed is:

1. A printing screen for printing deposits of a print medium onto workpieces, the printing screen comprising a sheet in which a pattern of printing apertures are formed to allow for printing of a pattern of deposits onto a workpiece, wherein the sheet can be mounted within a supporting frame, the frame extending around the periphery of the sheet, and a waveguide which can be driven to induce an ultrasonic vibration in the sheet, wherein the waveguide comprises an elongate body at a surface of the sheet which surrounds the pattern of printing apertures and is disposed inwardly of the supporting frame, and an actuator node to which an ultrasonic actuator may be coupled, wherein the waveguide is a single, continuous element which includes the actuator node in the path of the elongate body.

2. The printing screen of claim 1, wherein the elongate body of the waveguide comprises a plurality of elements which are disposed to adjacent sides of the pattern of printing apertures, and are coupled at corners.

3. The printing screen of claim 1, wherein the waveguide is formed separately of the sheet.

4. The printing screen of claim 3, wherein the waveguide is attached to the sheet.

5. The printing screen of claim 4, wherein the waveguide is welded to the sheet.

6. The printing screen of claim 4, wherein the waveguide is bonded to the sheet.

7. The printing screen of claim 6, wherein the waveguide is bonded to the sheet using a bonding agent.

8. The printing screen of claim 1, wherein the waveguide is integrally formed with the sheet.

9. The printing screen of claim 8 wherein the printing screen is electroformed, whereby the waveguide is grown out of one or both surfaces of the sheet.

10. The printing screen of claim 1, wherein the elongate body comprises corners, and the actuator node is located at a corner of the elongate body.

11. A printing screen unit, comprising:

the printing screen of claim 1;

a frame which supports the printing screen; and an ultrasonic generator which is operative to deliver an ultrasonic wave to the waveguide of the printing screen.

12. The printing screen unit of claim 11, wherein the ultrasonic generator comprises an ultrasonic actuator, which is coupled to the waveguide, the ultrasonic actuator being arranged and operative to generate in the waveguide an ultrasonic wave having a wavelength.

13. The printing screen unit of claim 12, wherein ultrasonic actuator is coupled to said actuator node, and wherein the elongate body of the waveguide has a length which corresponds to a multiple of a quarter wavelength of the ultrasonic wave generated in the waveguide by the ultrasonic actuator.

14. The printing screen unit of claim 12, wherein the ultrasonic actuator comprises first and second piezoelectric elements.

15. The printing screen unit of claim 14, wherein the ultrasonic actuator further comprises first and second mass elements which are disposed to opposite sides of the piezoelectric elements, and a fixing which interconnects the mass elements and compresses the piezoelectric elements.

16. A method of printing deposits of a print medium onto workpieces, the method comprising the steps of:

providing the printing screen unit of claim 11;

providing a workpiece support which supports a workpiece in relation to the printing screen unit;

providing a print head unit comprising a print head which is operable in a printing operation to drive a print medium through the pattern of printing apertures in the printing screen of the printing screen unit;

moving the printing screen unit and the workpiece support in relation to one another such that a workpiece is disposed adjacent the pattern of apertures in the printing screen of the printing screen unit;

operating the print head unit to perform a printing operation in which print medium is driven through the pattern of printing apertures in the printing screen of the printing screen unit onto the workpiece;

separating the printing screen of the printing screen unit and the workpiece support following the printing operation; and operating the ultrasonic generator to deliver an ultrasonic wave to the waveguide of the printing screen of the printing screen unit at least during part of the separating step.

17. The method of claim 16, wherein the print head unit further comprises a waveguide which is operable to induce an ultrasonic vibration in the print head and a further ultrasonic generator which is operable to deliver an ultrasonic wave to the waveguide of the print head unit, and further comprising the step of: operating the further ultrasonic generator to deliver an ultrasonic wave to the waveguide of the print head unit at least during part of the printing operation.

18. A method of cleaning a printing screen, the method comprising the steps of:

providing a cleaning bath containing a cleaning fluid;

disposing the printing screen of claim 1 in the cleaning bath;

coupling an ultrasonic generator which is operative to deliver an ultrasonic wave to the waveguide of the printing screen; and operating the ultrasonic generator to provide for cleaning of the printing screen.

19. The method of claim 18, wherein the ultrasonic generator comprises an ultrasonic actuator, optionally a piezoelectric element, which is coupled to the waveguide, optionally to an anti-nodal point along a length of the waveguide, optionally at one distal end of the waveguide.

20. A printing screen for printing deposits of a print medium onto workpieces, the printing screen comprising a sheet in which a pattern of printing apertures are formed to allow for printing of a pattern of deposits onto a workpiece, wherein the sheet can be mounted within a supporting frame, the frame extending around the periphery of the sheet, and a waveguide which can be driven to induce an ultrasonic vibration in the sheet, wherein the waveguide comprises an elongate body at a surface of the sheet which surrounds the pattern of printing apertures and is disposed inwardly of the supporting frame, and an actuator node to which an ultrasonic actuator may be coupled, wherein the actuator node comprises an aperture for coupling with the ultrasonic actuator in use.

21. The printing screen of claim 20, wherein the sheet comprises an aperture in correspondence with the aperture of the actuator node.

* * * * *